United States Patent [19]

Buddendeck et al.

[11] Patent Number: 4,980,723

[45] Date of Patent: Dec. 25, 1990

[54] HORIZONTAL IMAGE SHIFT BY SHIFTING TO A SLOWER COPYING RATE

[75] Inventors: Mark H. Buddendeck, Macedon; John W. Daughton; John C. DeMott, both of Rochester; Robert M. Harwood, Farmington; Gary L. Hutchinson, Fairport; Khalid M. Rabb, Webster; Robert L. Sklut, Rochester; Irwin Wagman, Pittsford, all of N.Y.

[73] Assignee: Xerox Corporation, Stamford, Conn.

[21] Appl. No.: 437,705

[22] Filed: Nov. 17, 1989

[51] Int. Cl.[5] ..... G03G 21/00; G03G 5/00

[52] U.S. Cl. ..... 355/218; 355/212

[58] Field of Search ..... 355/208, 218, 212, 324; 358/300; 346/108

[56] References Cited

U.S. PATENT DOCUMENTS

| | | | |
|---|---|---|---|
| 4,025,180 | 5/1977 | Kurita et al. | 355/212 X |
| 4,162,844 | 7/1979 | Traister et al. | 355/14 |
| 4,553,830 | 11/1985 | Nguyen | 355/208 X |
| 4,556,311 | 12/1985 | Tagoku | 355/212 |
| 4,611,908 | 9/1986 | Buch | 355/218 X |
| 4,707,126 | 11/1987 | Ohshima et al. | 355/14 R |
| 4,806,975 | 2/1989 | Godlove et al. | 355/218 |
| 4,809,039 | 2/1989 | Ishii | 355/14 R |

*Primary Examiner*—A. T. Grimley
*Assistant Examiner*—Nestor R. Ramirez
*Attorney, Agent, or Firm*—H. Fleischer; J. E. Beck; R. Zibelli

[57] ABSTRACT

An electrophotographic printing machine in which successive electrostatic latent images are recorded on a moving photoconductive belt. Each latent image is adapted to be recorded in a designated region on the photoconductive belt. The designated regions are separated from one another by an inter-image zone. A test patch is recorded in the inter-image zone. The number of designated regions on the photoconductive belt is adjusted so that the size of the inter-image zone is increased enabling a portion of the latent image to be recorded in the inter-image zone without overlapping any portion of the test patch.

10 Claims, 2 Drawing Sheets

HORIZONTAL IMAGE SHIFT BY SHIFTING TO A SLOWER COPYING RATE

Figure 1:
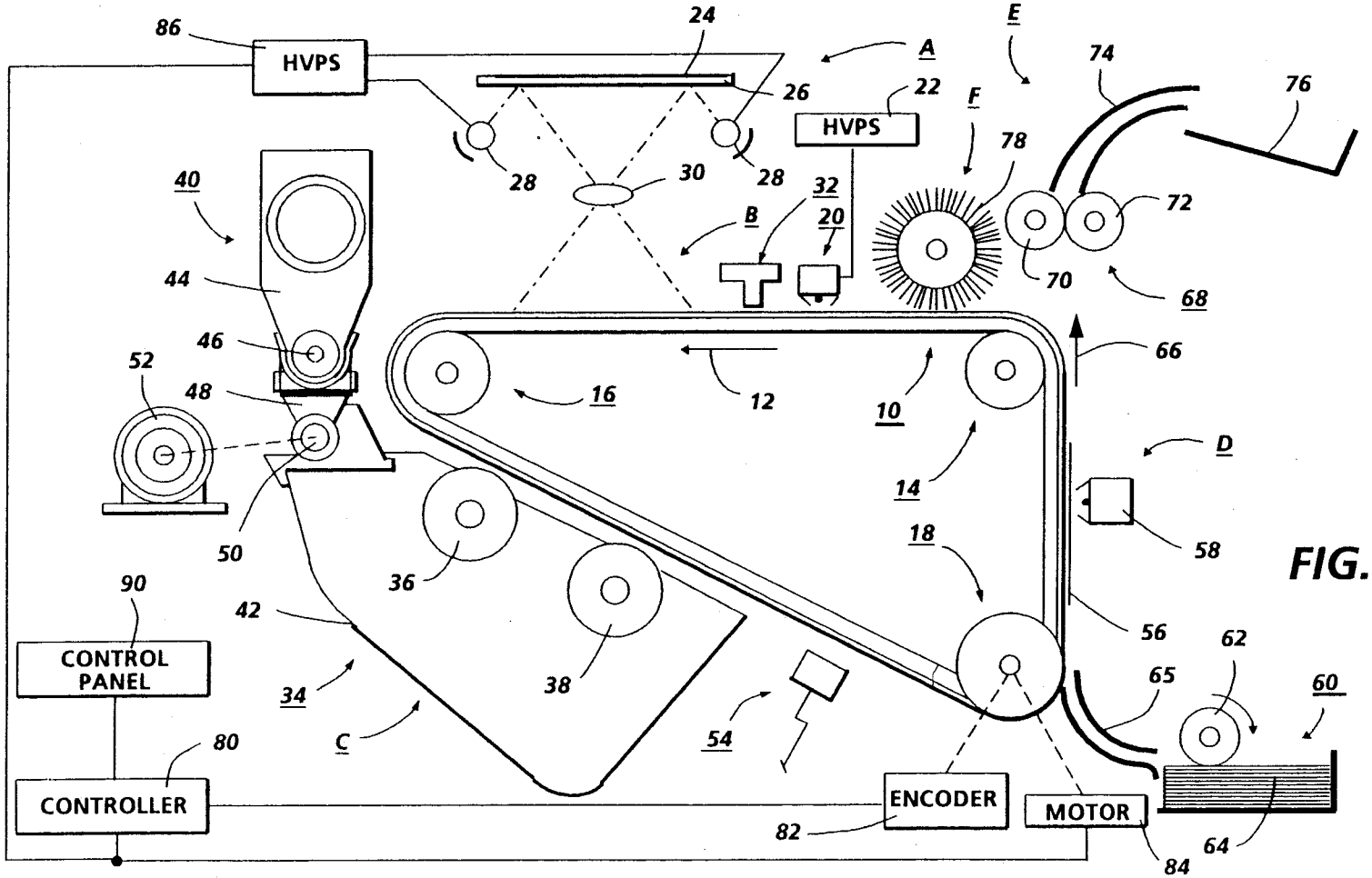

This invention relates generally to an electrophotographic printing machine, and more particularly concerns increasing the size of the inter-image zone so that a portion of a latent image can be shifted into the inter-image zone.

In a typical electrophotographic printing process, a photoconductive member is changed to a substantially uniform potential so as to sensitize the surface thereof. The charged portion of the photoconductive member is exposed to a light image of an original document being reproduced. Alternatively, a raster output scanner generating a modulated light beam, i.e. a laser beam, may be used to discharge selected portions of the charged photoconductive surface to record the desired information thereon. In this way, exposure of the charged photoconductive member selectively dissipates the charge in the irradiated areas to record an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In high speed electrophotographic printing machines, successive electrostatic latent images are recorded on a photoconductive belt side by side. The latent images are spaced from one another by an inter-image zone. A test patch may be recorded in the inter-image zone. The test patch is used to generate a signal for controlling various parameters of the printing machine. For example, a signal measuring the reflected light from a clean photoconductive surface may be compared to a signal reflected from a developed test patch. The resultant error signal regulates toner dispensing to control the concentration of toner particles in the developer material. In this type of system, the test patch is formed in the inter-image zone and developed to form a solid area of developer material on the photoconductive surface. In producing a set of copies, sheets with printed tabs may be inserted at selected intervals to divide portions of a set. In addition, it is frequently desirable to shift the position of the image on the copy in order to permit holes to be punched into the set of copy sheets or to allow binding or stapling of the set of copy sheets. In all of the cases, it is necessary to shift the latent image relative to the designated region on the photoconductive member. High speed printing machines record succesive latent images closely adjacent to one another with the size of the inter-image zone being minimized. The inter-image zone is generally only sufficiently large to enable test patches recorded therein to be read and to measure charge voltages to assist in controlling charging of the photoconductive belt. The spacing of the inter-image zone is extremely tight and shifting the latent image from the designated region into the inter-image zone without interfering with the process control operation complicates the control process and increases the complexity of the control software. Thus, it is desirable to be able to shift the latent image, at least partially, into the inter-image zone without interfering with the process control parameters. The following disclosures appear to be relevant:

U.S. Pat. No. 4,162,844; Patentee: Traister et al.; Issued: Jul. 31, 1979;

U.S. Pat. No. 4,707,126; Patentee: Ohshima et al.; Issued Nov. 17, 1987.

U.S. Pat. No. 4,809,039; Patentee: Ishii; Issued: Feb. 28, 1989.

The relevant portions of the foregoing patents may be summarized as follows:

U.S. Pat. No. 4,162,844 describes shifting the electrostatic latent image on a photoconductive belt by advancing the triggering of flash lamps a preset amount. The image shift is adjusted so that the images on opposed sides of a copy sheet are in registration.

U.S. Pat. No. 4,707,126 discloses shifting the position of the image on the copy relative to the position of the image on the original document by regulating scanning of the original document, movement of the illumination system or timing of the photoreceptor or copy sheet movement.

U.S. Pat. No. 4,809,039 discloses setting image potential timing, reference latent image timing and transfer timing to shift the image and prevent a reference density pattern from being recorded onto a copy sheet.

In accordance with one aspect of the present invention, there is provided a printing machine of the type in which successive latent images are recorded on a moving receiving member. The printing machine includes means for recording each latent image in a designated region on the receiving member. Means are provided for adjusting the number of designated regions on the receiving member so that the recording means can record a portion of the latent image in a zone between successive designated regions.

Pursuant to another aspect of the features of the present invention, there is provided an electrophotographic printing machine of the type in which successive electrostatic latent images are recorded on a moving photoconductive belt. The printing machine includes means for recording each latent image in a designated region on the photoconductive belt with each designated region being spaced from one another by an inter-image zone. Means record a test patch in the inter-image zone. Means are provided for adjusting the number of designated regions on the photoconductive belt so that the recording means can record a portion of the latent image in the inter-image zone without overlapping any portion of the test patch recorded therein.

Figure 2:
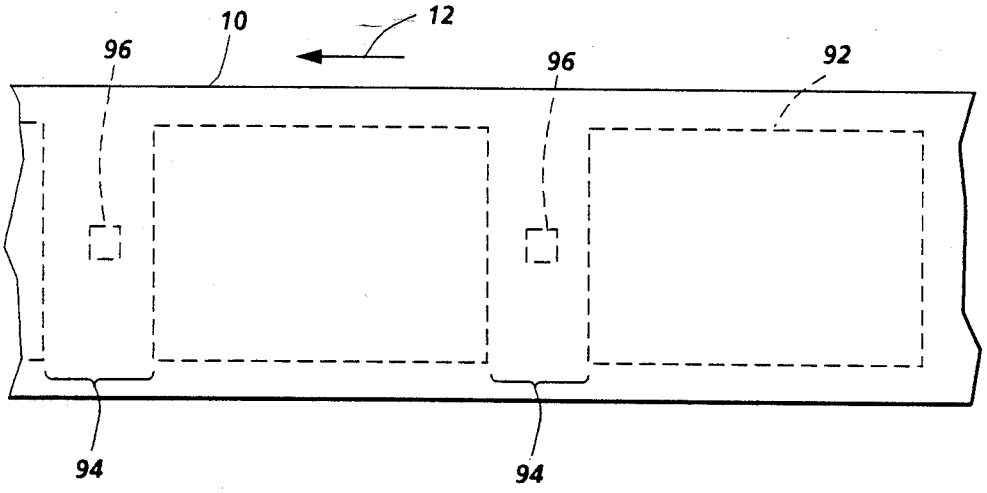
Figure 3:
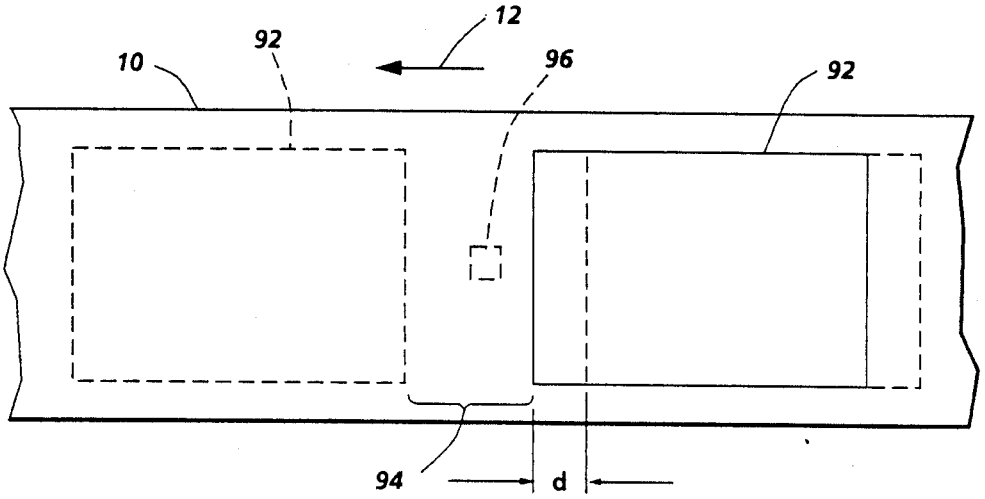

Other apsects of the present invention will become apparent as the following description proceeds and upon reference to the drawings, in which:

FIG. 1 is a schematic elevational view depicting an illustrative electrophotographic printing machine incorporating the features of the present invention therein;

FIG. 2 is a schematic plan view of a portion of the photoconductive belt used in the FIG. 1 printing machine showing designated regions having latent images recorded therein and in inter-image zones having test patches recorded therein; and FIG. 3 is a schematic plan view of a portion of the photoconductive belt used in the FIG. 1 printing machine showing designated regions having latent images recorded partially therein and partially in the in inter-image zone having the test patch recorded therein.

While the present invention will hereinafter be described in connection with a preferred embodiment thereof, it will be understood that it is not intended to limit the invention to that embodiment. On the contrary, it is intended to cover all alternatives, modifications, and equivalents, as may be included within the spirit and scope of the invention as defined by the appended claims.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the present invention may be employed in a wide variety of printing machines and is not specifically limited in its application to the particular embodiment depicted herein.

Referring to FIG. 1 of the drawings, the electrophotographic printing machine employs a photoconductive belt 10. Preferably, the photoconductive belt 10 is made from a photoconductive material coated on a ground layer, which, in turn, is coated on an anti-curl backing layer. The photoconductive material is made from a transport layer coated on a generator layer. The transport layer transports positive charges from the generator layer. The interface layer is coated on the ground layer. The transport layer contains small molecules of di-m-tolydiphenylbiphenyldiamine dispersed in a polycarbonate. The generation layer is made from trigonal selenium. The grounding layer is made from a titanium coated Mylar. The ground layer is very thin and allows light to pass therethrough. Other suitable photoconductive materials, ground layers, and anti-curl backing layers may also be employed. Belt 10 moves in the direction of arrow 12 to advance successive portions of the photoconductive surface sequentially through the various processing stations disposed about the path of movement thereof. Belt 10 is entrained about stripping roller 14, tensioning roller 16, and drive roller 18. Stripping roller 14 is mounted rotatably so as to rotate with belt 10. Tensioning roller 16 is resiliently urged against belt 10 to maintain belt 10 under the desired tension. Drive roller 18 is rotated by a motor 84 coupled thereto by suitable means such as a belt drive. As roller 18 rotates, it advances belt 10 in the direction of arrow 12.

Timing of the movement of photoconductive belt 10 in relation to the operation of the various subsystems of the printing machine is controlled by a timing hole (not shown) along one of the edges of photoconductive belt 10. The smallest image zone provided by the printing machine corresponds to the 6 pitch mode. This allows 6 image frames per belt revolution to be recorded on photoconductive belt 10. Thus, photoconductive belt 12 is divided into 6 designated regions with each designated region being adapted to have an electrostatic latent image recorded therein. The space between designated regions is the inter-image zone. At a fixed location along the path of movement of belt 10, there is positioned a light emitting diode and a photodiode for detecting the timing hole and for providing timing pulses to controller 80. An encoder 82 is linked to drive roller 18 and provides a series of timing pulses to controller 80 which are used in conjunction with pulses from the photodiode to control the operation of the printing machine.

Initially, a portion of the photoconductive surface passes through charging station A. At charging station A, a corona generating device, indicated generally by the reference numeral 20, charges the photoconductive belt 10 to a relatively high, substantially uniform potential. Corona generating device 20 includes a generally U-shaped shield and a charging electrode. A high voltage power supply 22 is coupled to the shield A change in the output of power supply 22 causes corona generating device 20 to vary the charge applied to the photoconductive belt 10.

Next, the charged portion of the photoconductive surface is advanced through imaging staion B. At imaging station B, an original document 24 is positioned face down upon a transparent platen 26. Imaging of a document is achieved by lamps 28 which illuminate the document on platen 26. Light rays reflected from the document are transmitted through lens 30. Lens 30 focuses the light image of the original document onto the charged portion of photoconductive belt 10 to selectively dissipate the charge thereon. This records an electrostatic latent image on the photoconductive belt which corresponds to the informational areas contained within the original document. A high voltage power supply 86 is coupled to lamps 28. Controller 80 is connected to high voltage power supply 86. Controller 80 regulates the energization of power supply 86 to set the timing of lamps 28. In this way, controller determines the on and off time of lamps 28. Lamps 28 are turned on to expose original document 24 in a timed sequence with the movement of belt 10 so that the latent images are recorded in the designated regions. Of course, if the timing of lamps 28 is advanced or delayed, i.e. lamps 28 are turned on before or after the nominal time, the latent image will be advanced or delayed with respect to the designated region and a portion of the latent image will extend into the inter-image zone.

Imaging station B includes a test area generator, indicated generally by the reference number 32. Test generator 32 exposes the photoconductive belt 10 in the inter-image zone to record a test patch thereon. The test patch recorded on photoconductive belt 10 is a rectangle approximately 1.8 centimeters wide by 4.0 centimeters high. The electrostatic latent image and test patch are then developed with toner particles at development station C. In this way, a toner powder image and a developed patch is formed on photoconductive belt 10. The developed test patch is subsequently examined to determine the quality of the toner image being developed on the photoconductive belt.

At development station C, a magnetic brush development system, indicated generally by the reference numeral 34, advances a developer material into contact with the electrostatic latent image and test patch recorded on photoconductive belt 10. Preferably, magnetic brush development system 34 includes two magnetic brush developer rollers 36 and 38. These rollers each advance the developer material onto contact with the latent image and test patch. Each developer roller forms a brush comprising carrier granules and toner particles. The latent image and test patch attract the toner particles from the carrier granules forming a toner powder image on the latent image and a developed test patch. As toner particles are depleted from the developer material, a toner particle dispenser, indicated generally by the reference numeral 40, furnishes additional toner particles to housing 42 for subsequent use by developer rollers 36 and 38, respectively. Toner dispenser 50 includes a container 44 storing a supply of toner particles therein. A foam roller 46 disposed in sump 48 coupled to container 44 dispenses toner particles into an auger 50. Auger 50 is made from a helical spring mounted in a tube having a plurality of apertures therein. Motor 52 rotates the helical spring to advance the toner particles through the tube so that the toner particles are dispensed from the apertures therein.

A densitometer 54, positioned adjacent the photoconductive belt between developer station C and transfer station D, generates electrical signals proportional to the developed test patch. These signals are conveyed to a control system and suitably processed for regulating the processing stations of the printing machine. Preferably, densitometer 54 is an infrared densitometer. Densitometer 54 includes a semiconductor light emitting diode and a photodiode to receive the light rays reflected from the developed test patch and converts the measured light ray input to an electrical output signal. The infrared densitometer is also used to periodically measure the light rays reflected from the bare photoconductive surface, i.e. without developed toner particles, to provide a reference level for calculation of the signal ratio. After development, the toner powder image is advanced to transfer station D.

At transfer station D, a copy sheet 56 is moved into contact with the toner powder image. The copy sheet is advanced to transfer station D by a sheet feeding apparatus 60. Preferably, sheet feeding apparatus 60 includes a feed roll 62 contacting the uppermost sheet of a stack 64 of sheets. Feed rolls 62 rotate so as to advance the uppermost sheet from stack 64 into chute 65. Chute 65 guides the advancing sheet from stack 64 into contact with the photoconductive belt in a timed sequence so that the toner powder image developed thereon contacts the advancing sheet at transfer station D. Nominally, the toner powder image is developed in the designated regions of photoconductive belt 10. A controller (not shown) actuates sheet feeder 60 at the appropriate time so that a toner powder developed in the designated region will be located in substantially the same location on the copy sheet as is the information contained in the original document. In the event the timing of lamps 28 is advanced or delayed, a portion of the latent image will extend out of the designated region into the inter-image zone. Similarly, the toner powder image will extend into the inter-image zone. This will result in the toner powder image transferred to the sheet being shifted so that the information on the copy sheet will be shifted relative to the information on the original document. This increases the size of the margin of the copy sheet permitting holes to be punched therein or facilitating binding and stapling thereof. In addition, this enables the information to be copied onto tab sheets. At transfer station D, a corona generating device 58 sprays ions onto the backside of sheet 56. This attracts the toner powder image from photoconductive belt 10 to copy sheet 56. After transfer, the copy sheet is separated from belt 10 and a conveyor advances the copy sheet, in the direction of arrow 66, to fusing station E.

Fusing station E includes a fuser assembly, indicated generally by the reference numeral 68 which permanently affixes the transferred toner powder image to the copy sheet. Preferably, fuser assembly 68 includes a heated fuser roller 70 and a pressure roller 72 with the powder image on the copy sheet contacting fuser roller 70. In this manner, the toner powder image is permanently affixed to sheet 56. After fusing, chute 74, guides the advancing sheet 56 to catch tray 76 for subsequent removal from the printing machine by the operator.

After the copy sheet is separated from photoconductive belt 10, the residual toner particles and the toner particles adhering to the test patch are cleaned from photoconductive belt 10. These particles are removed from photoconductive belt 10 at cleaning station F. Cleaning station F includes a rotatably mounted fiberous brush 78 in contact with photoconductive belt 10. The particles are cleaned from conductive belt 10 by the rotation of brush 78. Subsequent to cleaning, a discharge lamp (not shown) floods photoconductive belt 10 with light to dissipate any residual electrostatic charge remaining thereon prior to the charging thereof for the next successive imaging cycle.

In operation, the operator presses the shift button displayed on control panel 90. By way of example, control panel 90 may be a touch screen having a plurality of operator actuatable buttons displayed thereon. For example, there may be a display of a numerical keyboard including ten buttons for selecting the number of copies. A shift button may be displayed to shift the position of the information on the copy sheet relative to the position of the information on the original document. A tab button is also displayed to allow copying on tabs. This button will automatically shift the information on the copy so as to fall on the tabs of the copy sheet. One skilled in the art will appreciate that the control panel will also display many other features such as image lighter and darker buttons, a clear button, magnification control buttons, etc. Control panel 90 transmits a signal to controller 80. Controller 80 regulates power suply 86 to adjusts the timing of the energization of lamps 28. Initially the timing of the energization of lamps 28 is adjusted so that the number of times the photoconductive belt is exposed per cycle of revolution is decreased to correspond to the decrease in the number of designated regions. Thus, the nominal time between successive exposures of the original document is increased and a new nominal time is used for energization of lamp 28 corresponding to a decrease in the number of designated regions. In this way, the number of latent images recorded on photoconductive belt 10 is decreased, e.g. from 6 to 5 per cycle of belt revolution. Since each latent image is recorded in a designated region, the number of designated regions per cycle of belt revolution is also decreased from 6 to 5. By decreasing the number of designated regions per cycle of belt revolution, the inner-image zone is increased in size. In order to shift the latent image relative to the designated region, the timing of the energization of lamps 28 is adjusted relative to the new nominal time, i.e. advance or delay the timing relative to a nominal time. This shifts the recordation of the latent image so that a portion thereof extends from the designated region into the inner-image zone. When the printing machine is operating in its normal mode of operation, i.e. at 100 copies per minute, the process speed is about 400 millimeters per second and there are designated regions with the inter-image zone between each designated region being about 2.285 centimeters. Under these circumstances shifting the latent image relative to the desingated region by 0.25 centimeters will cause the latent image to over lay the test patch. Thus, the space of the inter-image zone has to be increased. This is accomplished by downshifting the system, i.e. decreasing the number of designated regions on the photoconductive belt, the space between designated regions, i.e. the inner-image zone, increases in size. For example, if the number of designated regions, i.e. the number of electrostatic latent images recorded on the photoconductive belt in one cycle, is decreased from 6 to 5 the size of the inner-image zone increases from 2.285 centimeters to about 7 centimeters. This enables the image to be shifted by almost 2.6 centimeters without over laying the test patch. The test patch is recorded in the center of the inter-image zone and is a rectangle 1.8 centimeters wide by 4.0 centimeters high. In addition to the direct shift selected by the operator, there is an indirect shift that is automatically applied whenever the operator programs copying on tabs. This shift is 1.27 centimeters. Thus, whenever copying onto tabs is selected on control panel 90, the system downshifts from 6 designated regions to 5 designated regions. When the printing machine is operating with 5 designated regions, the printing machine produces 83 copies per minute. One skilled in the art will appreciate that the printing machine may downshift even further i.e. to 4 designated regions and 67 copies per minute in the event it is necessary to increase the inter-image zone a greater amount, or in case it is desired to obtain an image shift for larger copies that would normally operate in the 5 pitch mode. Preferably, controller 80 is a programmable microcomputer which has a stored program therein for actuating functions of the printing machine. For example a commercially available microprocessor such as the Intel Model 8085, may be used either singly or in a distributed control system.

Referring now to FIG. 2, there is shown photoconductive belt 10 moving in the direction of arrow 12 at 400 millimeters per second with 6 designated regions 92 thereon. Each designated region 92 is identical and only a fragment of belt 10 is shown in FIG. 2. Each designated region is about 8.5 inches by 11 inches. The inner-image zone 94 defines the distance between adjacent designated regions 92 and is about 2.285 centimeters. A test patch 96 is recorded in each inter-image zone 94. Test patch 96 is a rectangle 1.8 centimeters wide by 4.0 centimeters high, centered in the inter-image zone. When the latent image is shifted with respect to designated region 92, it extends into inter-image zone 92. For example, a shift of about 1.27 centimeters will cause the latent image to overlay test patch 96. Thus, it is necessary to increase the size of the inter-image zone. This is accomplished by decreasing the number of designated regions from 6 to 5. FIG. 3 shows a photoconductive belt 10 having 5 designated regions thereon.

Turning now to FIG. 3, there is shown the electrostatic latent image 98 shifted a distance d, where d is 1.27 centimeters. The shift shown in FIG. 3 is achieved by advancing the timing of the energization of lamps 28 (FIG. 1) by 0.03175 seconds. Inasmuch as there are only 5 designated regions 92 on photoconductive belt 10, the inter-image zone is about 7.0 centimeters. Test patch 96 is located in the center of the inter-image zone 94. Shifting the latent image 1.27 centimeters into inter-image zone 94 does not interfere with test patch 96. Even with the latent image shifted 1.27 centimeters into inter-image zone 94, test patch 96 is spaced a distance of about 1.33 centimeters from end 100 of latent image 98. One skilled in the art will appreciate that the adjacent images may be shifted in the same direction or in opposite directions.

In recapitulation, the printing machine of the present invention is adapted to downshift to decrease the number of designated regions having electrostatic latent images recorded therein. By decreasing the number of designated regions, the inter-imge zone, i.e. distance between designated regions is increased. This permits the electrostatic latent image to be shifted relative to the designated region so that a portion thereof extends into the inter-image zone without over laying the test patch recorded therein.

It is, therefore, evident that there has been provided, in accordance with the present invention, a printing machine that fully satisfies the aims and advantages hereinabove set forth. While this invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

We claim:

1. A printing machine of the type in which successive latent images are recorded on a moving photoconductive belt, including:

means for recording each latent image in a designated region on the receiving member, said recording means comprises means for charging said photoconductive belt, means for supporting an original document and means for exposing the original document being supported on said supporting means and selectively discharging the charge on the photoconductive belt to record a latent image thereon;

means for adjusting the number of designated regions on the photoconductive belt so that said recording means can record a portion of the latent image in a zone between successive designated regions, said adjusting means decreases the number of designated regions on the receiving member of increase the size of the zone between successive designated regions; and means, coupled to said recording means, for positioning the latent image recorded on said receiving member relative to the designated region, said positioning means includes means, coupled to said exposure means, for controlling the timing of the exposure of the original document to the shift location of the latent image recorded on the photoconductive belt relative to the designated region so that a portion of the latent image extends into the zone between successive designated regions.

2. A printing machine according to claim 1, wherein said controlling means advances exposure of the original document to shift the location of the latent image recorded on the photoconductive belt relative to the designated region in one direction.

3. A printing machine according to claim 2, wherein said controlling means delays exposure of the original document to shift the location of the latent image recorded on the photoconductive belt relative to the designated region in the opposite direction.

4. A printing machine according to claim 1, further including operator actuatable means, coupled to said controlling means, for selecting the magnitude of shift of the latent image recorded on the photoconductive belt relative to the designated region.

5. An electrophotographic printing machine of the type in which successive electrostatic latent images are recorded on a moving photoconductive belt, including:

means for recording each latent image in a designated region on the photoconductive belt with each designated region being spaced from one another by an inter-image zone, said recording means includes means for charging said photoconductive belt, means for supporting an original document, and means for exposing the original document being supported on said supporting means and selectively discharging the charge on the photoconductive belt to record the latent image thereon;

means for recording a test patch in the inter-image zone;

means for adjusting the number of designated regions on the photoconductive belt so that said recording means can record a portion of the latent image in the inter-image zone without overlapping any portion of the test patch recorded therein, said adjusting means decreases the number of designated regions on the photoconductive belt to increase the size of the inter-image zone; and means, coupled to said recording means, for positioning the latent image recorded on said receiving member relative to the designated region, said positioning means includes means, coupled to said exposure means, for controlling the timing of the exposure of the original document to shift the location of the latent image recorded on the photoconductive belt relative to the designated region so that a portion of the latent image extends into the zone between successive designated regions.

6. A printing machine according to claim 5, wherein said controlling means advances exposure of the original document to shift the location of the latent image recorded on the photoconductive belt relative to the designated region in one direction.

7. A printing machine according to claim 6, wherein said controlling means delays exposure of the original document to shift the location of the latent image recorded on the photoconductive belt relative to the designated region in the opposite direction.

8. A printing machine according to claim 5, further including operator actuatable means, coupled to said controlling means, for selecting the magnitude of shift of the latent image recorded on the photoconductive belt relative to the designated region.

9. A printing machine of the type in which successive latent images are recorded on a moving photoconductive member, including:

means for recording each latent image in a designated region on the photoconductive member, said recording means comprising means for charging said photoconductive member, means for supporting an original document, and means for exposing the original document being supported on said supporting means and selectively discharging the charge on the photoconductive member to record a latent image thereon;

means for adjusting the number of designated regions on the photoconductive member so that recording means can record a portion of the latent image in a zone between successive designated regions; and means, coupled to said exposure means, for controlling the timing of the exposure of the original document to shift the location of the latent image recorded on the photoconductive member relative to the designated region so that a portion of the latent image extends into the zone between successive designated regions.

10. An electrophotographic printing machine of the type in which successive electrostatic latent images are recorded on a moving photoconductive belt, including:

means for recording each latent image in a designated region on the photoconductive belt with each designated region being spaced from one another by an inter-image zone, said recording means includes means for charging said photoconductive belt, means for supporting an original document, and means for exposing the original document being supported on said supporting means and selectively discharging the charge on the photoconductive belt to record the latent image thereon;

means for recording a test patch in the inter-image zone;

means for adjusting the number of designated regions on the photoconductive belt so that said recording means can record a portion of the latent image in the inter-image zone without overlapping any portion of the test patch recorded therein; and means, coupled to said exposure means, for controlling the timing of the exposure of the original document to shift the location of the latent image recorded on the photoconductive belt relative to the designated region so that a portion of the latent image extends into the zone between successive designated regions.

* * * * *